US007109936B2

(12) United States Patent
Mizoguchi et al.

(10) Patent No.: US 7,109,936 B2
(45) Date of Patent: Sep. 19, 2006

(54) ANTENNA AND RADIO COMMUNICATION DEVICE PROVIDED WITH THE SAME

(75) Inventors: Satoshi Mizoguchi, Ome (JP); Takashi Amano, Soka (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/947,528

(22) Filed: Sep. 22, 2004

(65) Prior Publication Data

US 2005/0151691 A1 Jul. 14, 2005

(30) Foreign Application Priority Data

Jan. 13, 2004 (JP) ..... 2004-005437

(51) Int. Cl.
*H01Q 21/00* (2006.01)

(52) U.S. Cl. ..... 343/726; 343/795; 343/702

(58) Field of Classification Search ..... 343/726, 343/795

See application file for complete search history.

(56) References Cited

U.S. PATENT DOCUMENTS

| | | | | |
|---|---|---|---|---|
| 5,808,584 | A | 9/1998 | Skahill | |
| 5,936,590 | A * | 8/1999 | Funder | 343/795 |
| 6,285,336 | B1 * | 9/2001 | Zimmerman | 343/803 |
| 6,317,099 | B1 * | 11/2001 | Zimmerman et al. | 343/803 |
| 6,535,175 | B1 * | 3/2003 | Brady et al. | 343/795 |
| 6,606,067 | B1 * | 8/2003 | Oh et al. | 343/741 |
| 6,721,611 | B1 * | 4/2004 | Schneider et al. | 700/84 |
| 6,842,158 | B1 * | 1/2005 | Jo et al. | 343/895 |
| 2004/0001028 | A1 * | 1/2004 | Killen et al. | 343/795 |
| 2004/0001029 | A1 * | 1/2004 | Parsche et al. | 343/866 |
| 2004/0196202 | A1 * | 10/2004 | Shirosaka et al. | 343/795 |
| 2005/0119035 | A1 * | 6/2005 | Miyano et al. | 455/575.7 |

FOREIGN PATENT DOCUMENTS

| | | | |
|---|---|---|---|
| EP | 0 566 522 | B1 | 12/1999 |
| EP | 1 098 391 | A2 | 5/2001 |
| JP | 10-32418 | A | 2/1998 |
| JP | 2001-339215 | A | 12/2001 |
| JP | 2002-9534 | A | 1/2002 |
| JP | 2004-201049 | A | 7/2004 |
| WO | WO 02/095870 | A1 | 11/2002 |

* cited by examiner

*Primary Examiner*—Tan Ho
*Assistant Examiner*—Binh Van Ho
(74) *Attorney, Agent, or Firm*—Frishauf, Holtz, Goodman & Chick, P.C.

(57) ABSTRACT

An antenna is shaped to include a substantially 1-wavelength loop portion and a pair of dipole portions. The loop portion includes vertical portions, which are located opposite to each other in a vertical direction. The dipole portions share part of the loop portion, and are located opposite to each other in a horizontal direction.

6 Claims, 16 Drawing Sheets

0.50λ/0.69λ

0.50λ/0.76λ

0.53λ/0.83λ

0.63λ/1.01λ

0.69λ/1.29λ

0.91λ/2.19λ

—·—·— VERTICALLY POLARIZED WAVE
——— HORIZONTALLY POLARIZED WAVE 0.61λ/0.79λ

0.62λ/0.82λ

0.62λ/0.86λ

0.64λ/1.01λ

0.65λ/1.10λ

0.67λ/1.24λ

—·—·— VERTICALLY POLARIZED WAVE

——— HORIZONTALLY POLARIZED WAVE

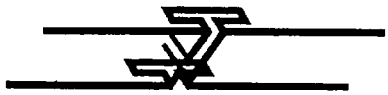
0.72λ/0.59λ
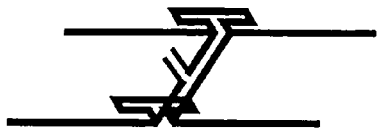
0.70λ/0.72λ
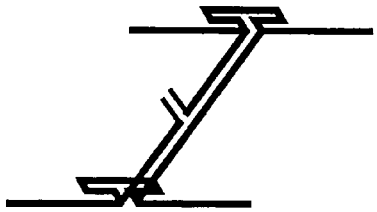
0.68λ/0.98λ
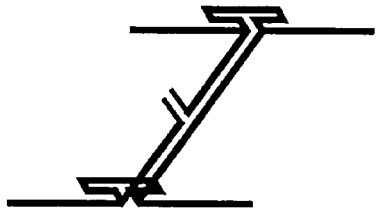
0.64λ/1.06λ
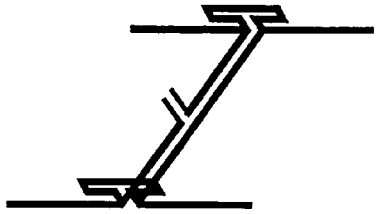
0.62λ/1.15λ
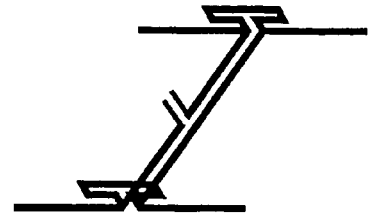
0.61λ/1.26λ
FIG.16A FIG.16B FIG.61C FIG.16D FIG.16E FIG.16F
—·—·— VERTICALLY POLARIZED WAVE
——— HORIZONTALLY POLARIZED WAVE
FIG.16G FIG.16H FIG.16I FIG.16J FIG.16K FIG.16L

ANTENNA AND RADIO COMMUNICATION DEVICE PROVIDED WITH THE SAME

CROSS-REFERENCE TO RELATED APPLICATIONS

This application is based upon and claims the benefit of priority from prior Japanese Patent Application No. 2004-005437, filed Jan. 13, 2004, the entire contents of which are incorporated herein by reference.

BACKGROUND OF THE INVENTION

1. Field of the Invention

The present invention relates to an antenna and a radio communication device provided with the antenna.

2. Description of the Related Art

When a portable radio communication device is in a communication state, a user's head is located close to the portable radio communication device. In this case, if a radiation pattern of a wave radiated from an antenna provided in the portable radio communication device has a main lobe on a side of the communication device which is close to the user's head, the radiation characteristics of the antenna are greatly varied due to an influence of the user's head, etc., thereon.

As techniques for overcoming such a disadvantage, those disclosed in Jpn. Pat. Appln. KOKAI Publications No. 2002-9534 and No. 2001-339215 are known.

In a portable radio communication device disclosed in Jpn. Pat. Appln. KOKAI Publication No. 2002-9534, an antenna is provided in a housing. The antenna comprises a linear feed element and a linear passive element, which are arranged substantially parallel to each other. The feed element and the passive element extend in a direction perpendicular to the front surface of the housing (which is a surface on which a receiver is provided). The passive element is spaced apart from the feed element in a direction away from the front surface of the housing. To the feed element, current is supplied from feeding means. As a result, the feed element functions as a dipole antenna.

The antenna has a directivity wherein radiation of a wave radiated from the antenna has a peak in a direction from the feed element toward the passive element, due to an operation of a combination of the feed element and the passive element. That is, the antenna has characteristics wherein a radiated wave is directed toward the rear side of the housing, thus reducing the influence of a living body close to the front side of the housing upon the antenna.

Jpn. Pat. Appln. KOKAI Publication No. 2001-339215 discloses an antenna including two feed elements and two passive elements. To be more specific, in the antenna, the two feed elements and the two passive elements are arranged such that the two passive elements are interposed between the two feed elements or the two feed elements are interposed between the two passive elements. Then, currents having opposite phases are supplied to the feed elements, respectively, thereby reducing current flowing through the housing of a radio device, and reducing lowering of the characteristics of the antenna which is caused by an influence of a living body thereon.

However, it is necessary for the antennas disclosed in the above Publications to perform balanced feeding or provide two feeding points, in order to obtain desired radiation characteristics. To carry out balanced feeding, the feeding means needs to include a balun, thus increasing the cost of parts, the loss due to provision of the balun, the area for mounting the parts and the variance in characteristics among manufactured antennas. Also, in the case where two feeding points are provided, the cost of parts, the area for mounting the parts and the variance in characteristics among manufactured antennas increase.

On the other hand, in both a balanced feeding method and an unbalanced feeding method, a loop antenna is known as an antenna in which the variation amount of a radiation pattern is small.

FIG. 22 is a view illustrating the distribution of current at a square 1-wavelength loop antenna. In this type of loop antenna, currents having the same phase are generated at a pair of horizontal elements when the horizontal elements are excited. Thus, as shown in FIG. 23, a horizontally polarized wave is radiated in a direction (X direction) perpendicular to a plane defined by the pair of horizontal elements and a pair of vertical elements. The pair of vertical elements are excited to generate currents having opposite phases at the vertical elements. Thus, as shown in FIG. 23, a vertically polarized wave is radiated in a direction (Y direction) along the horizontal elements. As shown in FIG. 22, current flowing through each of the horizontal elements is larger in value than that of current flowing through each of the vertical elements, and thus the vertically polarized wave is smaller than the horizontally polarized wave.

In such a manner, in the 1-wavelength loop antenna, it is inevitable that a wave greatly radiates in the X direction. In order to restrict radiation of a wave toward the front side of the housing of the portable radio communication device, it is necessary to direct the plane defined by the horizontal elements and vertical elements of the loop antenna in a direction perpendicular to the front surface of the housing. Therefore, the thickness of the housing (i.e., the distance between the front surface and rear surface of the housing) must be sufficiently increased.

FIG. 24 is a view showing the distribution of current at a square 2-wavelength loop antenna. As shown in FIG. 24, in the case where the length of the antenna is set to correspond to two wavelengths, currents having opposite phases are respectively generated at a pair of horizontal elements when the horizontal elements are excited. Also, currents having opposite phases are respectively generated at a pair of vertical elements when the vertical elements are excited. Thus, as shown in FIG. 25, a vertically polarized wave is strongly radiated in the Y direction, and radiation of a horizontally polarized wave in the X direction can be restricted.

Therefore, in the 2-wavelength loop antenna, a plane defined by the horizontal elements and vertical elements is located parallel to the front surface of the housing, and in addition radiation of a wave toward the front side of the housing can be reduced.

However, the 2-wavelength loop antenna occupies a large space in the housing, since its length is great.

In such a manner, conventional antennas have disadvantages in which balanced feeding must be performed or a large space in the housing is occupied by structural elements.

In view of such circumstances, it has been required that an antenna is made small, and in addition reduces radiation of a wave in a specific direction even when unbalanced feeding is performed by using one feeding point only.

BRIEF SUMMARY OF THE INVENTION

According to first aspect of the present invention, there is provided an antenna comprising a substantially 1-wavelength loop portion including a first portion and a second portion, which are located opposite to each other in a first direction and a pair of dipole portions which share part of the loop portion, and which are located opposite to each other in a second direction perpendicular to the first direction.

According to second aspect of the present invention, there is provided an antenna comprising (i) a substantially 1-wavelength loop portion including a first portion and a second portion, which are located opposite to each other in a first direction, and (ii) a pair of dipole portions which share part of the loop portion, and which are located opposite to each other in a second direction perpendicular to the first direction and feeding means for performing unbalanced feeding on the first portion.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 16A to 16L are views respectively showing how radiation patterns are obtained in the case where the loop length Llp is varied while the dipole length Ldp is fixed.

DETAILED DESCRIPTION OF THE INVENTION

An embodiment of the present invention will be explained with reference to the accompanying drawings.

Figure 1:
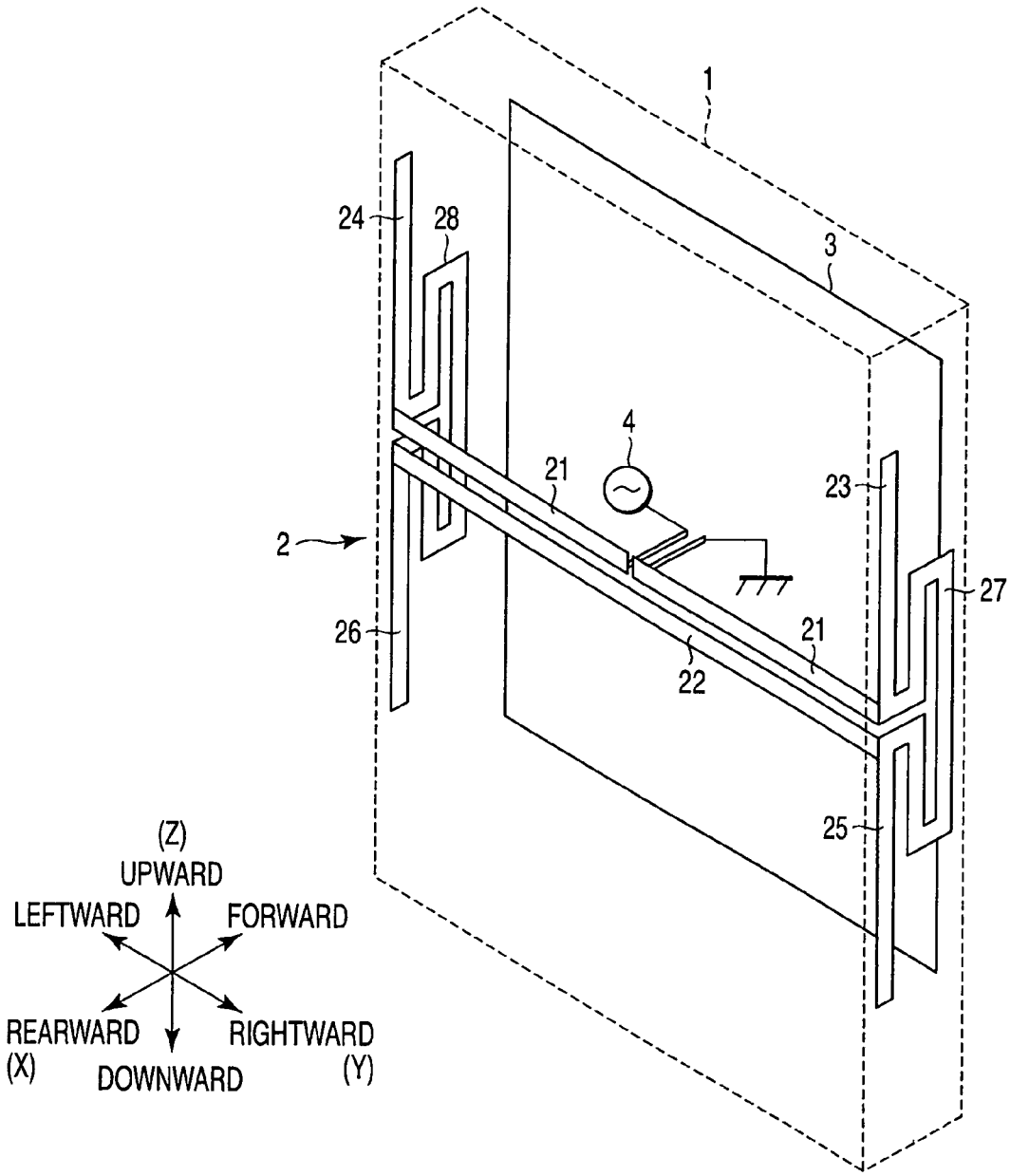
FIG. 1 is a perspective view of the structure of a portable radio communication device according to an embodiment of the present invention.

FIG. 1 is a perspective view of the structure of a portable radio communication device according to the embodiment of the present invention. As shown in FIG. 1, the portable radio communication device according to the embodiment includes an antenna 2 provided in a housing 1. The housing 1 also contains a circuit board 3. In order to clearly illustrate the structure of the antenna 2, in FIG. 1, the housing 1 is shown by broken lines as a matter of convenience for explanation.

Suppose "forward", "rearward", "leftward", "rightward", "upward" and "downward" directions are determined with respect to the housing 1 as shown in FIG. 1. The housing 1 is thin in the forward or rearward direction. On a front surface of the housing 1, a receiver portion not shown, etc. are provided. It should be noted that the above directions are defined as relative directions with respect to the housing 1 as a matter of convenience, not absolute directions.

The antenna 2 is formed of conductive material, and includes horizontal portions 21 and 22, vertical portions 23, 24, 25 and 26, and shorting portions 27 and 28.

The horizontal portions 21 and 22 are spaced apart from each other. The horizontal portions 21 and 22 are located in parallel with each other to extend along the rightward or leftward direction. The horizontal portion 21 is divided into two parts with respect to its center, and one of them is connected to feeding means 4 provided in the circuit board 3, and the other is connected to PCB-GND located on the circuit board 3. The feeding means 4 does not include a balun, and performs unbalanced feeding to the horizontal portion 21.

The vertical portions 23 and 24 extend upwards from both ends of the horizontal portion 21. The vertical portions 25 and 26 extend downwards from both ends of the horizontal portion 22.

The shorting portion 27 extends from one end of the horizontal portion 21 in the forward direction, and turns to the left (in the upward direction), to the right (in the forward direction), to the right (in the downward direction), to the right (in the rearward direction), to the right (in the upward direction) and to the left (in the rearward direction) in this order, and is then connected to one end of the horizontal portion 22. The shorting portion 28 extends from the other end of the horizontal portion 21 in the forward direction, and turns to the left (in the upward direction), to the right (in the forward direction), to the right (in the downward direction), to the right (in the rearward direction), to the right (in the upward direction) and to the left (in the rearward direction) in this order, and is then connected to the other end of the horizontal portion 22.

The antenna 2 is provided in the housing 1 such that an imaginary plane in which the horizontal portions 21 and 22 are located is parallel to the front surface of the housing 1. Needless to say, the above term "imaginary plane" is used in geometrically explaining the positions of the horizontal portions 21 and 22, i.e., it does not mean an real object serving as a structural element in the portable radio communication terminal.

Next, the operation of the antenna 2 in the portable radio communication apparatus will be explained.

Figure 2B:
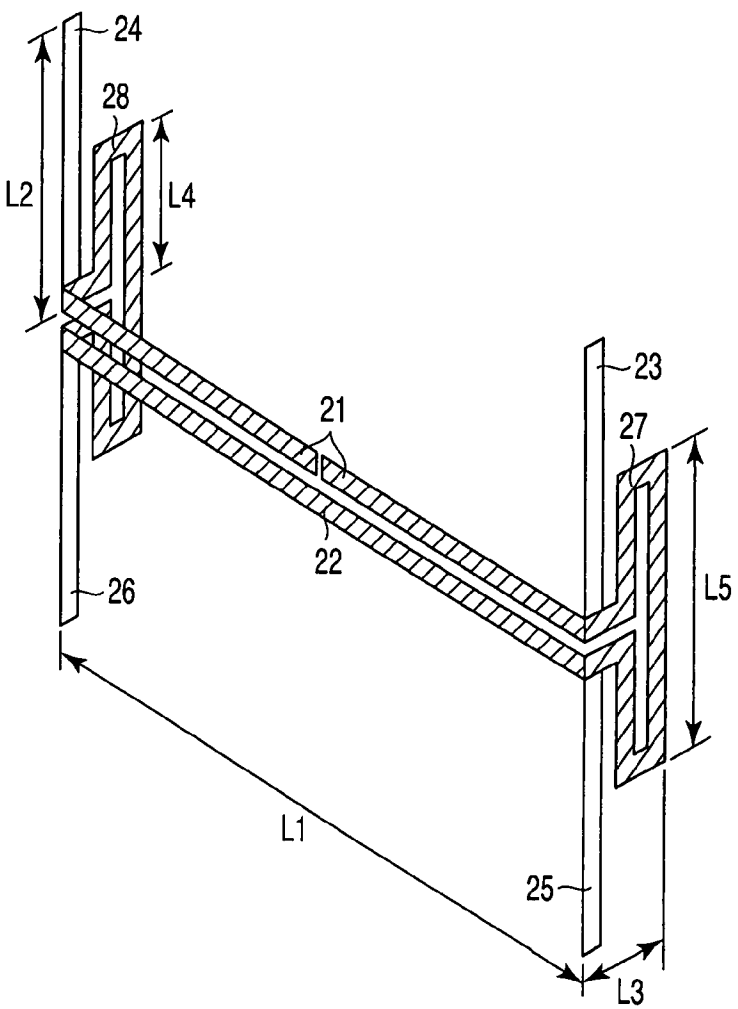
FIGS. 2A and 2B are views showing a dipole portion and a loop portion included in an antenna shown in FIG. 1.
Figure 2A:
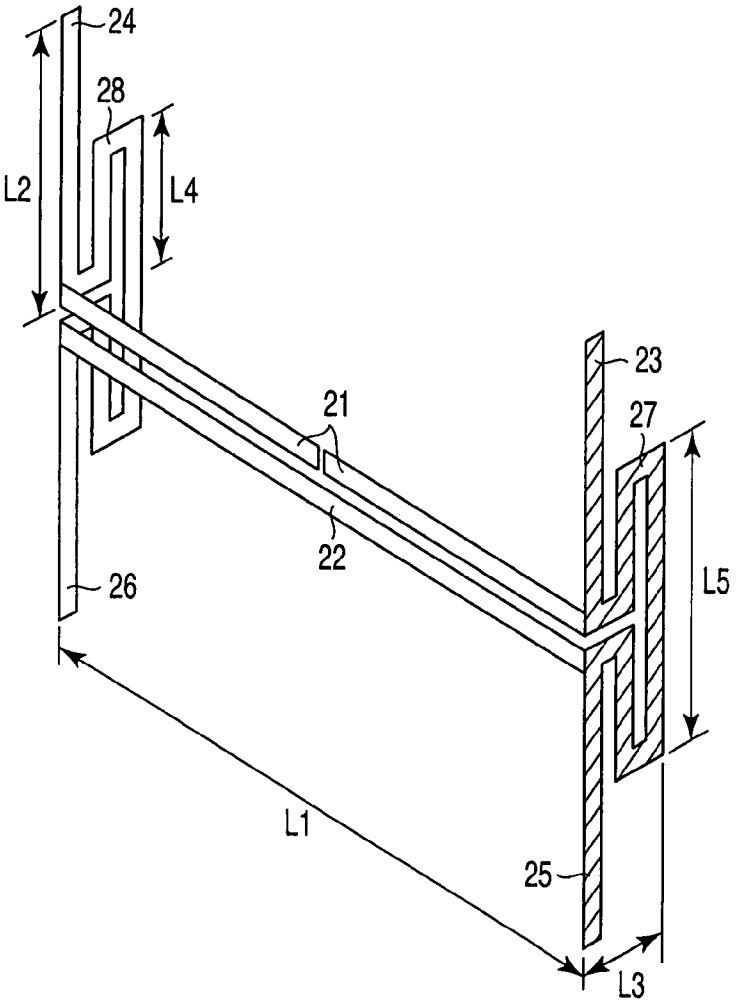

Since the antenna 2 has the above structure, the vertical portions 23 and 25 and the shorting portion 27 serve as a dipole portion as hatched in FIG. 2A. Also, the vertical portions 24 and 26 and the shorting portion 28 serve as a dipole portion. Furthermore, the horizontal portions 21 and 22 and the shorting portions 27 and 28 serve as a loop portion as hatched in FIG. 2B.

Where L1 to L5 are the lengths of portions of the antenna 2 which are indicated in FIGS. 2A and 2B.

The length "Ldp" of each of the dipole portions is expressed by the following equation:

$$Ldp=2\times L2+2\times L3+2\times L4+L5$$

The length "Llp" of the loop portion is expressed by the following equation:

$$Llp=2\times L1+4\times L3+4\times L4+2\times L5$$

Figure 3:
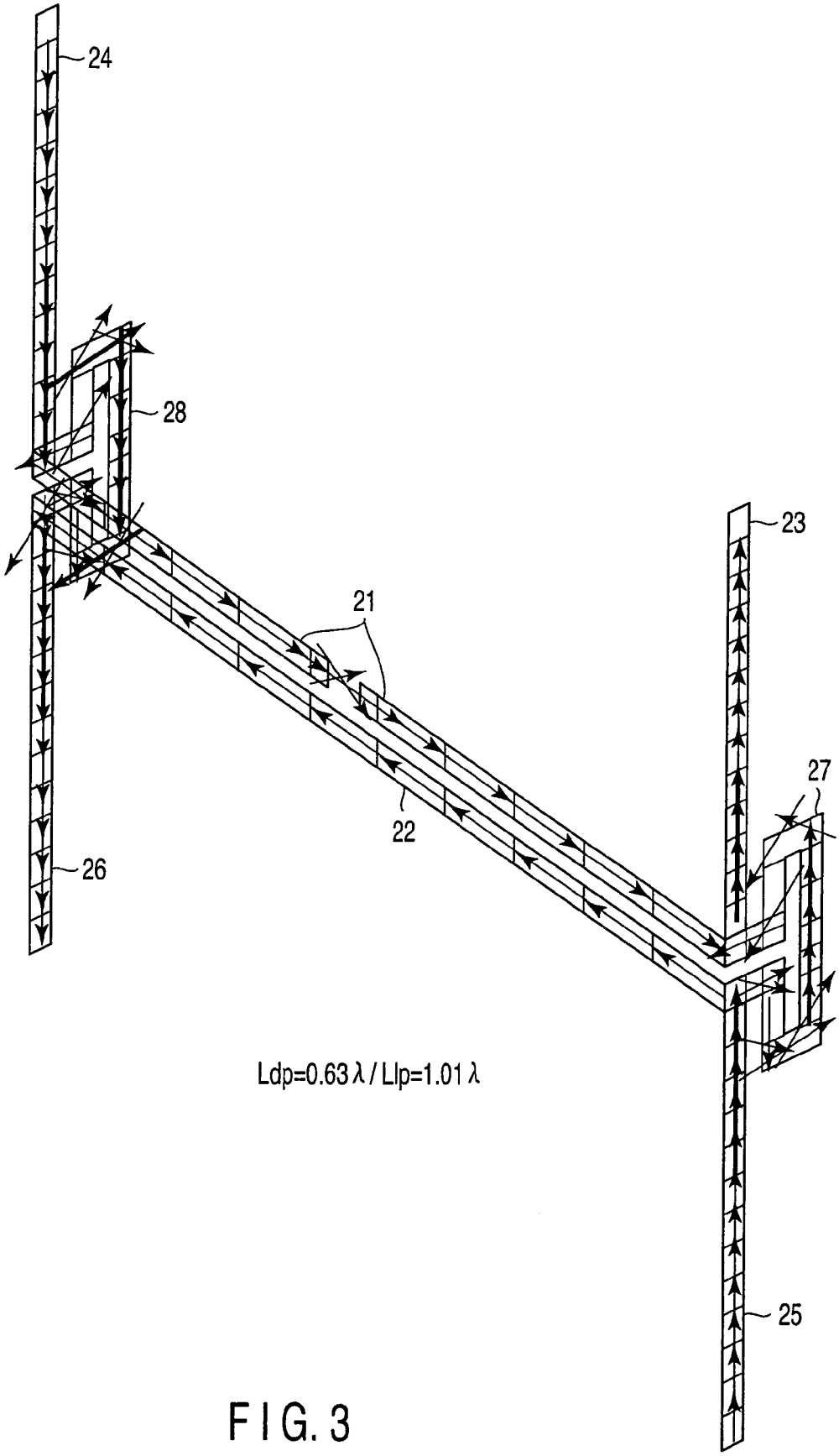
FIG. 3 is a view showing the current distribution of the antenna which is obtained when current is supplied from feeding means to a horizontal portion in the antenna in FIG. 1.

FIG. 3 is a view showing the current distribution of the antenna 2 which is obtained when current is supplied from the feeding means 4 to the horizontal portion 21. In FIG. 3, the direction of each of arrows indicates a current phasor, and the thickness of each arrow indicates the strength of the current phasor.

When "Llp" corresponds to one wavelength, the loop portion functions as a one-wavelength loop. However, as can be seen from FIG. 3, when the above pair of dipole portions are excited to generate currents having opposite phases at the dipole portions, the horizontal portions 21 and 22 are also excited to generate current having opposite phases at the horizontal portions 21 and 22. Then, when the vertical portions 21 and 22 are located to extend in the vertical direction, the direction of the phasor of the current at each of the dipole portions is also the vertical direction, and thus a vertically polarized wave is radiated due to the phasor of the current at each dipole portion. Also, at this time, since the direction of the phasor of the current at each of the horizontal portions 21 and 22 is the horizontal direction, a horizontally polarized wave is radiated due to the phasor of the current at each of the horizontal portions 21 and 22.

Figure 4:
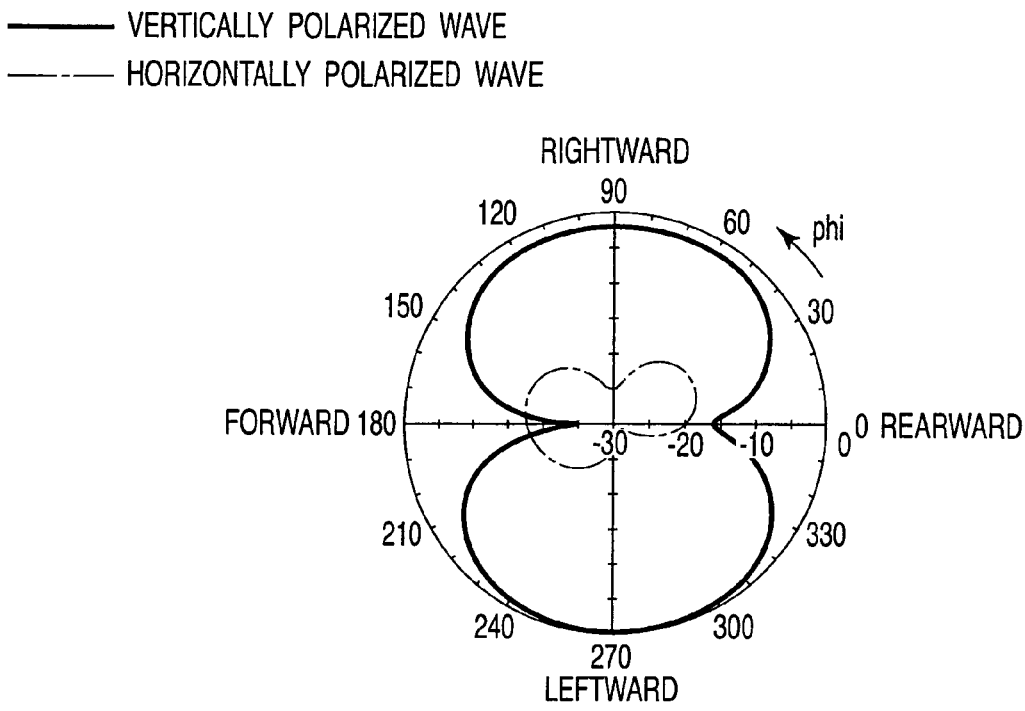
FIG. 4 is a view showing a radiation pattern (at an XY plane) of the wave radiated from the antenna as viewed from above with respect to a housing of the device in FIG. 1.

FIG. 4 is a view showing a radiation pattern (at an XY plane) of the wave from the antenna 2 as viewed from above with respect to the housing 1. As shown in FIG. 4, at the XY plane, a vertically polarized wave is radiated as a main polarized wave. The radiation pattern of the vertically polarized wave has a null close to an axis extending between the front and rear sides of the housing 1. This is because, of radiated energy, rightward energy and leftward energy which are close to the axis between the front and rear sides of the housing 1 are canceled by each other, since the phases of the currents at the dipole portions are opposite to each other.

Figure 5:
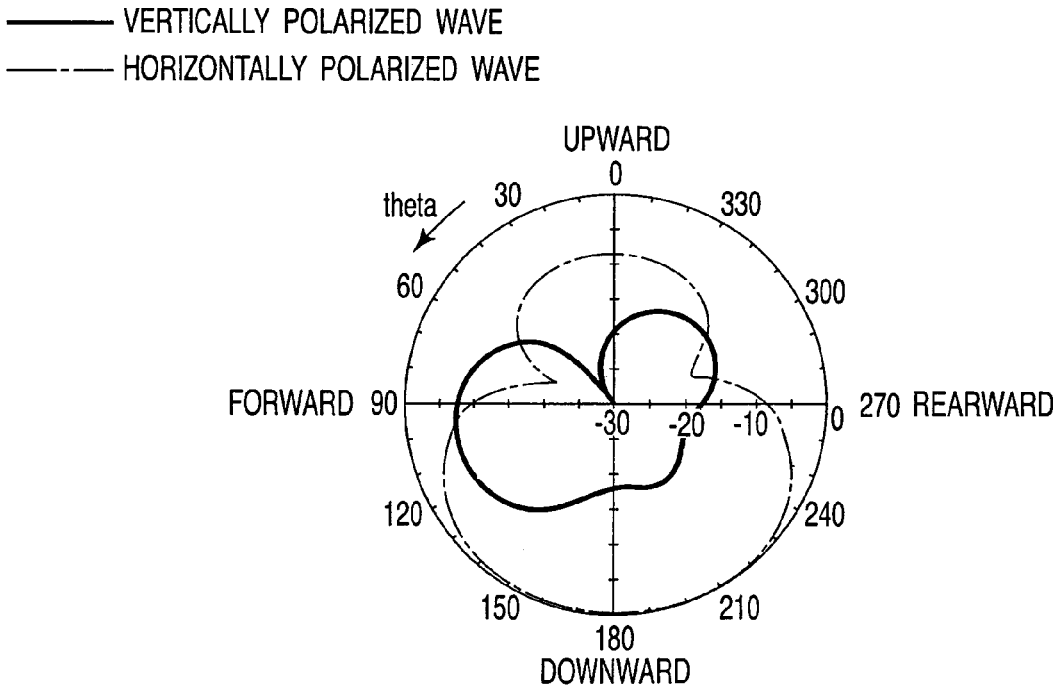
FIG. 5 is a view showing a radiation pattern (at a ZX plane) of the wave radiated from the antenna as viewed from left with respect to the housing in FIG. 1.
Figure 6A:
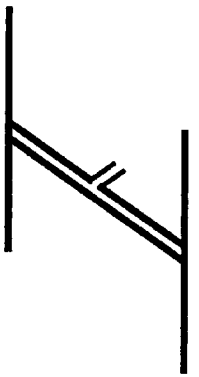
FIGS. 6A to 6L are views showing respective radiation patterns of the waves radiated from variations of the antenna 2 which have different loop lengths L1 and different dipole lengths Ldp which are adjusted such that their resonance (operation) frequencies are all 2 GHz.
Figure 6B:
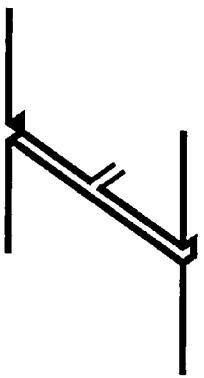
Figure 6C:
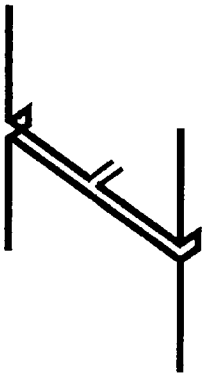
Figure 6D:
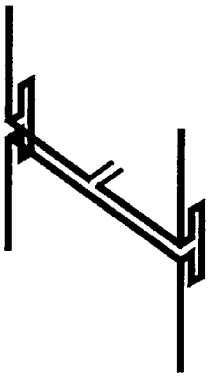
Figure 6E:
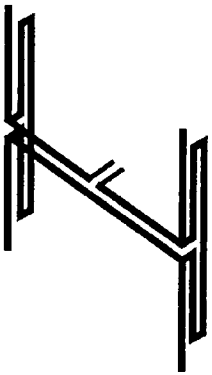
Figure 6F:
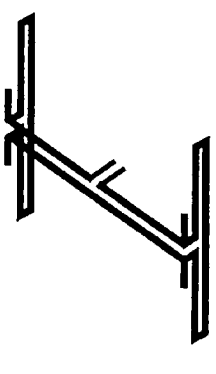
Figure 6G:
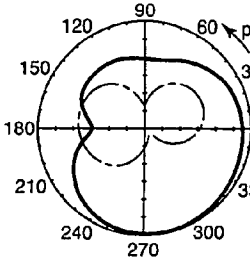
Figure 6H:
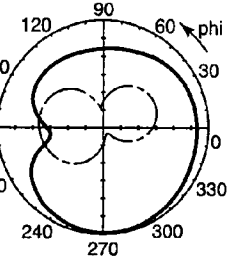
Figure 6I:
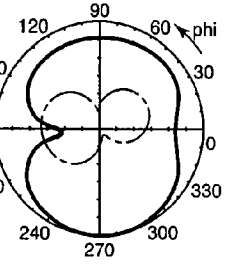
Figure 6J:
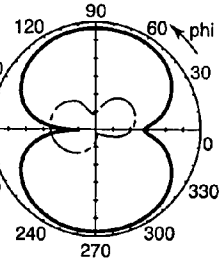
Figure 6K:
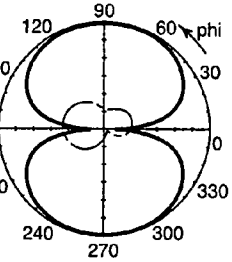
Figure 6L:
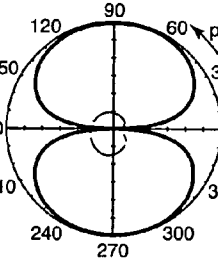

FIG. 5 is a view showing a radiation pattern (at a ZX plane) of the wave from the antenna 2 as viewed from left with respect to the housing 1. As shown in FIG. 5, a horizontally polarized wave is radiated as a main polarized wave. The radiation pattern of the horizontally polarized wave has a null close to the axis extending between the front and rear sides of the housing 1. This is because, of radiated energy, upward energy and downward energy which are close to the axis extending between the front and rear sides of the housing 1 are canceled by each other, since the phases of the currents at the horizontal portions 21 and 22 are opposite to each other. It should be noted that referring to FIG. 5, the null of the radiation pattern of the horizontally polarized wave is displaced from the above axis. This is because the strength of the phasor of current at the horizontal portion 21 is different from that at the horizontal portion 22, since unbalanced feeding is performed.

In such a manner, the radiation pattern of each of both the vertically and horizontally polarized waves have a null close to the axis extending between the front and rear of the housing 1, at the plane where each wave is radiated as a main polarized wave. That is, radiation of an electromagnetic field in the forward and backward directions is restricted. In addition, at the XY plane, a horizontally polarized wave also appears, and at the ZX plane, a vertically polarized wave also appears. However, the influence of those polarized waves on radiation of the electromagnetic field in the forward and backward directions is small, they are smaller than main polarized waves.

FIGS. 6A to 6L are views respectively illustrating how radiation patterns are obtained at the XY plane, in the case where the loop length Llp is varied while the dipole length Ldp is adjusted such that the resonance (operation) frequency is 2 GHz.

To be more specific, FIGS. 6A to 6F show variations of the antenna 2 which have loop lengths L1 of "0.69 λ", "0.76 λ", "0.83 λ", "1.01 λ", "1.29 λ" and "2.19 λ", respectively. The dipole lengths Ldp of the variations of the antenna 2 are "0.50 λ", "0.50 λ", "0.53 λ", "0.63 λ", "0.69 λ" and "0.91 λ", respectively. FIGS. 6G to 6L show radiation patterns at the XY plane which are obtained by the variations of the antenna 2, respectively.

Figure 7:
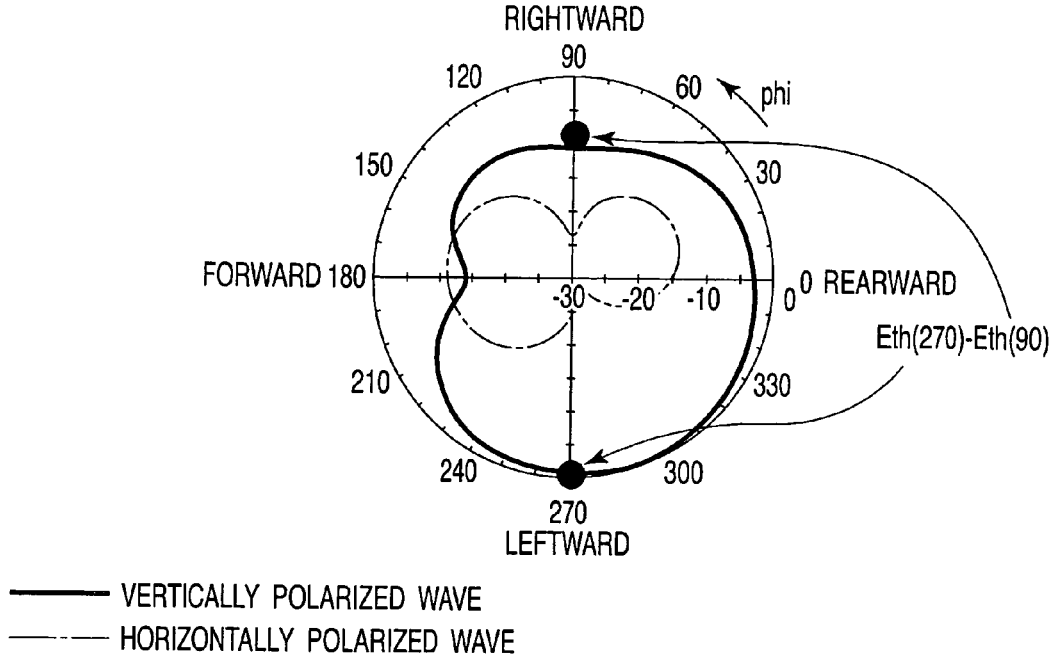
FIG. 7 is a view illustrating the leftward and rightward strengths of each of the vertically polarized waves.
Figure 8:
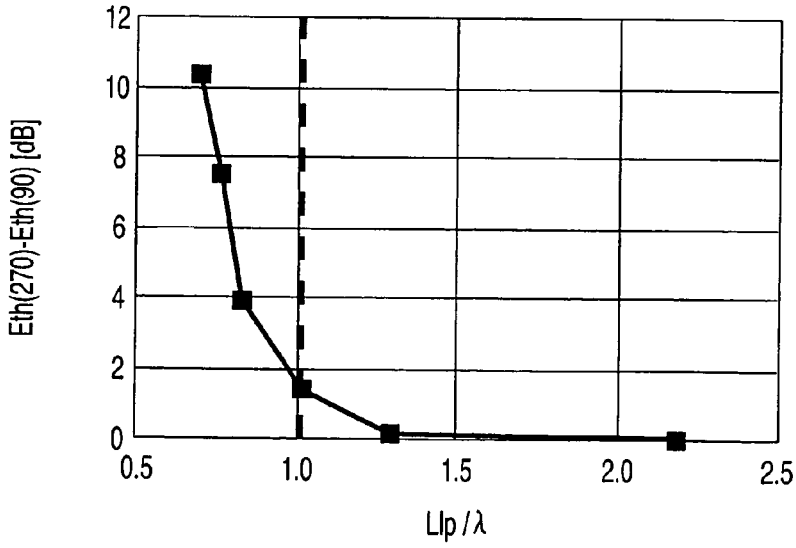
FIG. 8 is a view graphing the relationship between the loop length Llp and the difference between the leftward and rightward strengths of each of vertically polarized waves having radiation patterns shown in FIGS. 6A to 6L.

As shown in FIG. 7, when the leftward strengths of the radiation patterns of the vertically polarized waves at the XY plane, which are shown in FIGS. 6G to 6L, are Eth(90), and the rightward strengths of the radiation patterns of the above vertically polarized waves are Eth(270), the difference between the rightward and leftward strengths of each of the vertically polarized waves is "Eth(270)−Eth(90)". The relationship between the above difference and the loop length Llp is graphed as shown in FIG. 8.

The smaller the difference, the better the balance between the rightward and leftward strengths. As can be seen from FIG. 8, it can be said that the greater the loop length Llp, the smaller the difference, and the above balance is satisfactory when the loop length Llp is equal to or more than 1 wavelength.

Figure 9:
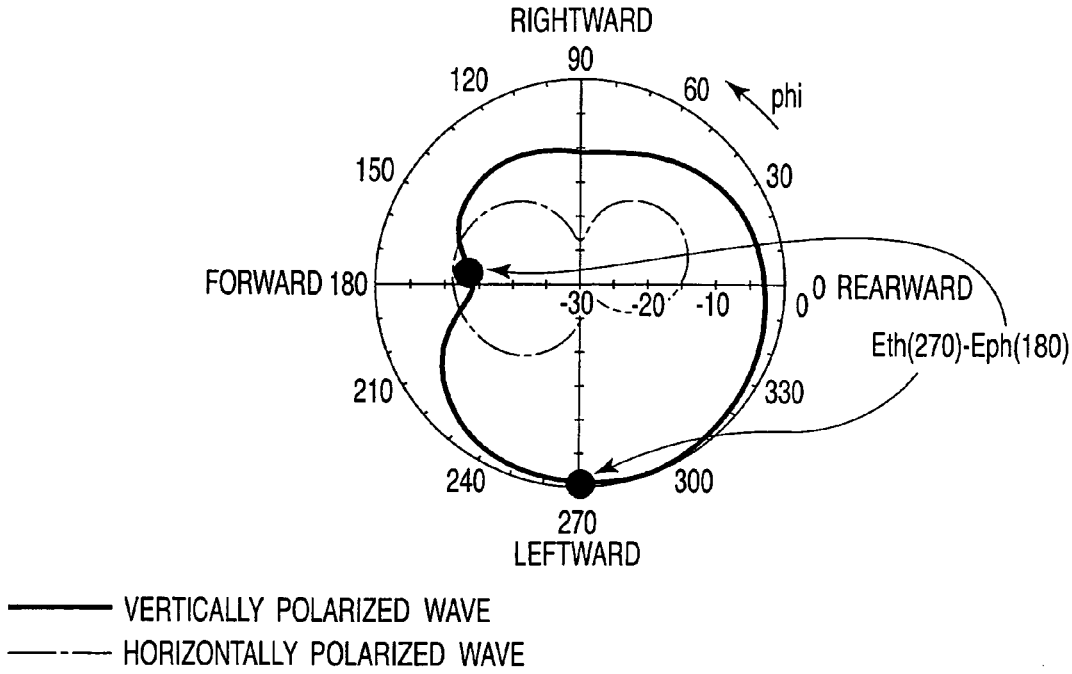
FIG. 9 is a view illustrating the relationship between the maximum strength of each of the vertically polarized waves at the XY plane and the strength of each of horizontally polarized waves in a forward direction.
Figure 10:
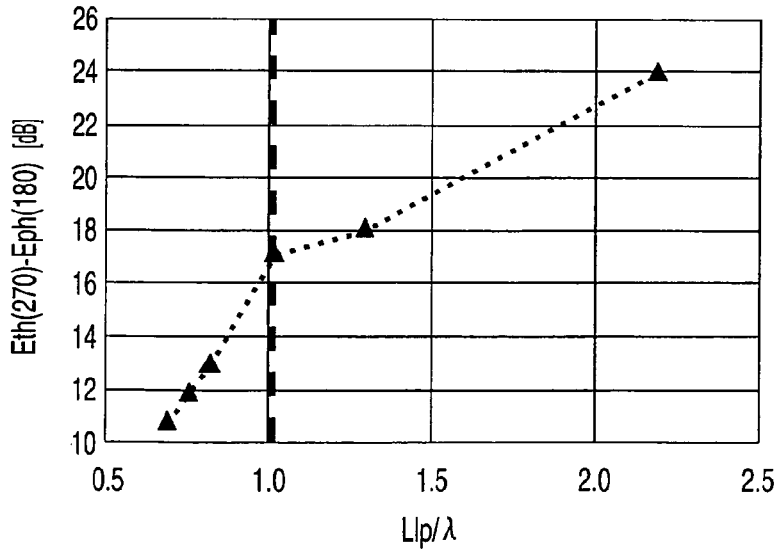
FIG. 10 is a view graphing the relationship between the loop length Llp and the difference between the maximum strength of each of the vertically polarized waves having radiation patterns at the XY plane, which are shown in FIGS. 6G to 6L.

On the other hand, as shown in FIG. 9, where with respect to the radiation patterns at the XY plane, which are shown in FIGS. 6G to 6L, the maximum strength of each of the vertically polarized waves is Eth(270), and the strength of each of the horizontally polarized waves in the forward direction is Eph(180), as shown in FIGS. 6G to 6L, the relationship between the difference between Eth(270) and Eph(180) and the loop length Llp is graphed as shown in FIG. 10.

The influence of the horizontally polarized wave on radiation of an electromagnetic field in the forward direction decreases as the difference between Eth(270) and Eph(180) increases. It can be said from FIG. 10 that the difference between Eth(270) and Eph(180) increases as the loop length Llp increases, and it is sufficiently great when the loop length Llp is equal to or more than 1 wavelength.

FIGS. 11A to 11L are views respectively illustrating how radiation patterns are obtained at the XY plane, in the case where the dipole length Ldp is varied while the loop length Llp is fixed.

To be more specific, FIGS. 11A to 11F show variations of the antenna 2 which have different dipole lengths Ldp, respectively. FIGS. 11G to 11L show radiation patterns which are obtained at the XY plane by the variations of the antenna 2, respectively, shown in FIGS. 11A to 11F.

Figure 11A:
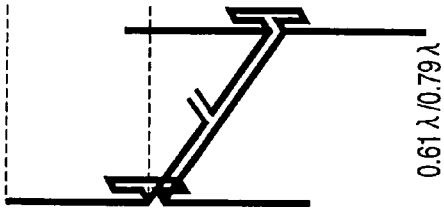
FIGS. 11A to 11L are views respectively illustrating how radiation patterns of vertically polarized waves are obtained at the XY plane, in the case where the dipole length Ldp is varied while the loop length Llp is fixed.
Figure 11B:
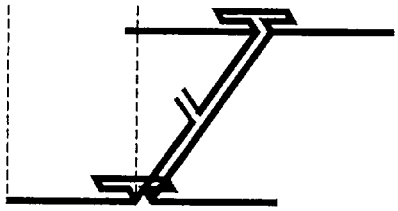
Figure 11C:
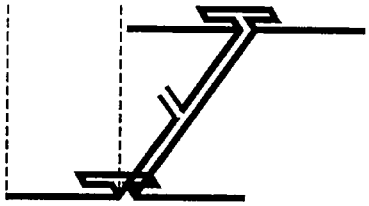
Figure 11D:
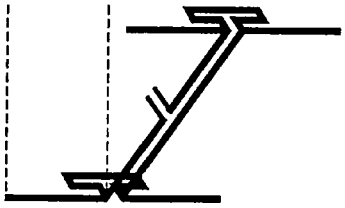
Figure 11E:
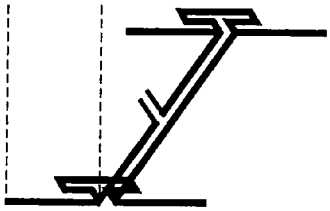
Figure 11F:
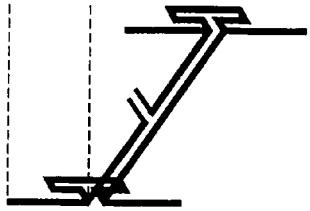
Figure 11G:
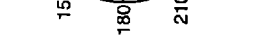
Figure 11H:
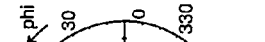
Figure 11I:
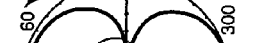
Figure 11J:
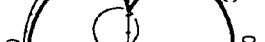
Figure 11K:
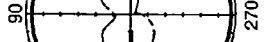
Figure 11L:
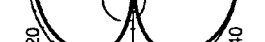

As stated above, the variations of the antenna 2 have respective dipole lengths Ldp and the same loop length Llp, as shown in FIGS. 11A to 11F. For example, the variation of the antenna 2 which is shown in FIG. 11A has a dipole length Ldp of "0.61 λ" and a loop length of "0.79 λ". It should be noted that referring to FIGS. 11A to 11F, the resonance frequencies of the variations of the antenna 2 are different since their dipole lengths are different. That is, the values of "λ" of the variations of the antenna 2 which are shown in FIGS. 11A to 11F are different from each other.

As can be seen from FIGS. 11A to 11F, even if the dipole length Ldp is varied, the ratio of the dipole length Ldp to the wavelength "λ" is not greatly varied. That is, the wavelengths "λ" of the variations shown in FIGS. 11A to 11F fall within the range of "0.61 λ" to "0.67 λ". Then, the ratio of the loop length Ldp to the wavelength "λ" is greatly varied.

Figure 12:
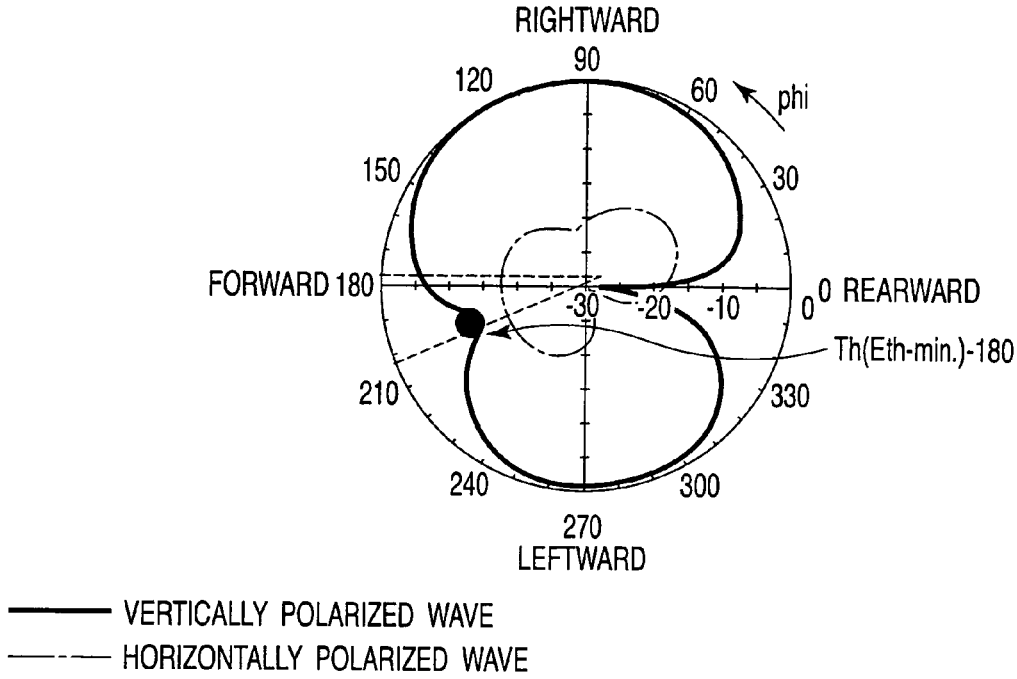
FIG. 12 is a view for use in explaining the angle between the forward direction (180°) and a null direction, i.e., a direction in which a null is present.
Figure 13:
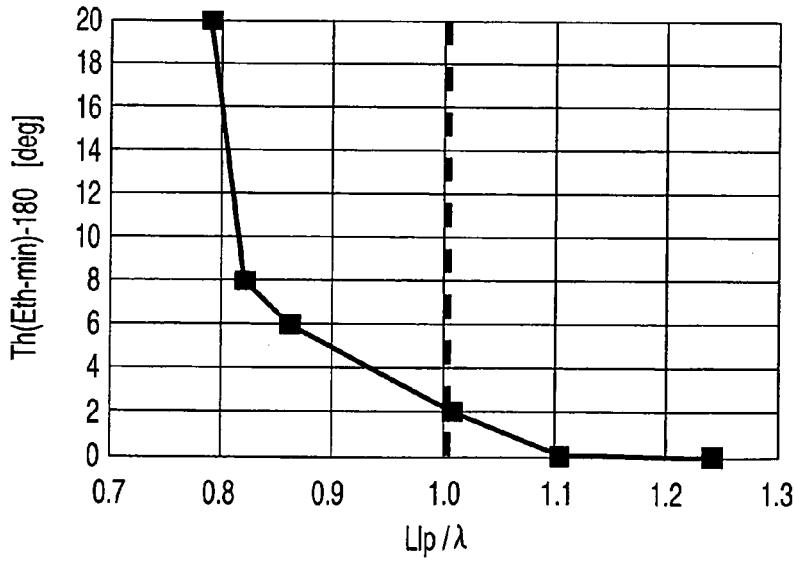
FIG. 13 is a view illustrating the relationship between the loop length Llp and the angle between the forward direction and the null direction in each of the radiation patterns of the vertically polarized waves shown in FIGS. 11A to 11L.

As shown in FIG. 12, where the angle of the direction in which the strength of each of the vertically polarized waves at the XY plane, which have the radiation patterns shown in FIGS. 11G to 11L, is the minimum is "Th(Eth-min.)", the difference in angle between the forward direction (180°) and a null direction, i.e., a direction in which a null is present, is "Th(Eth-min.)−180". The relationship between the above difference and the loop length Llp is graphed as shown in FIG. 13.

The smaller the above difference, the better the balance between the rightward and leftward strengths of each wave. To be more specific, as can be seen from FIG. 13, the greater the loop length Llp, the smaller the difference. The difference is equal to or less than 2°, when the loop length Llp is equal to or more than 1 wavelength. In this case, the balance between the rightward and leftward strengths is sufficiently satisfactory.

Figure 14:
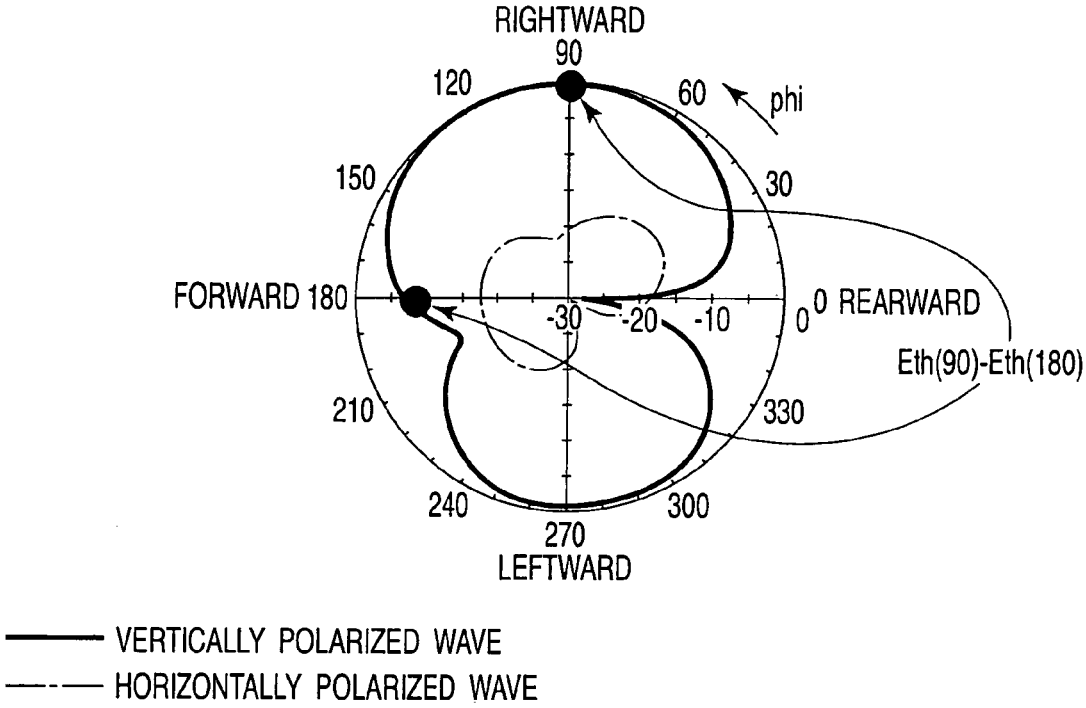
FIG. 14 is a view for use in explaining the difference between the forward strength and rightward strength of a radiation pattern of a vertically polarized wave at the XY plane.

On the other hand, when the balance between the rightward and leftward strengths in the radiation pattern at the XY plane is ideal, the forward strength is the minimum, and the leftward strength is the maximum. Thus, as shown in FIG. 14, where with respect to each of the radiation patterns of the vertically polarized waves shown in FIGS. 11G to 11L, the forward strength is Eth(180), and the leftward strength is Eth(90), the greater the difference between the forward strength and the leftward strength, i.e., "Eth(90)−Eth(180)", the better the function of restricting radiation of the wave in the forward direction. The relationship between the above difference and the loop length Llp is graphed as shown in FIG. 15.

Figure 15:
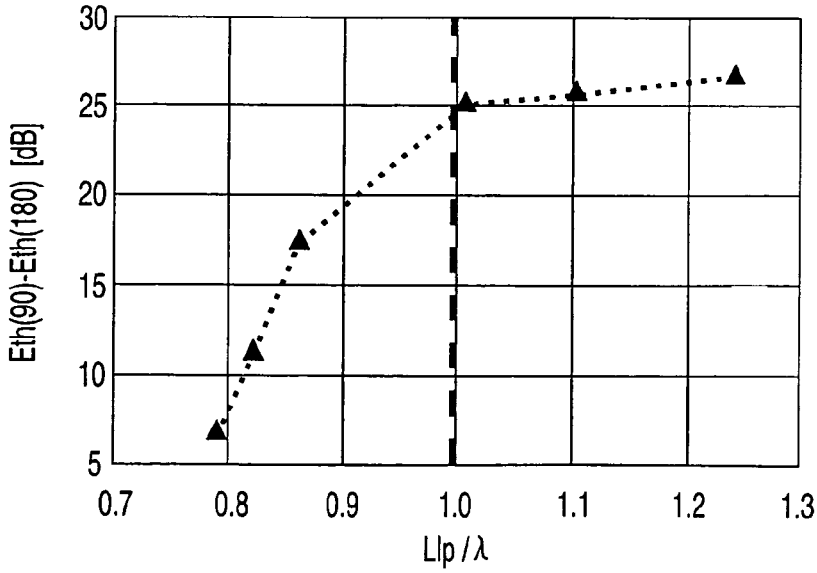
FIG. 15 is a view graphing the relationship between the loop length Llp and the difference between the forward strength and leftward strength of each of the vertically polarized waves having radiation patterns at the XY plane, which are shown in FIGS. 11A to 11L.

As can be seen from FIG. 15, the greater the loop length Llp, the greater the difference between the forward direction and the null direction. When the loop length Llp is equal to or more than 1 wavelength, the difference between the leftward and forward strengths is equal to or more than 20 dB. The radiation is sufficiently restricted.

FIGS. 16A to 16L are views respectively showing how radiation patterns are obtained in the case where the loop length Llp is varied while the dipole length Ldp is fixed.

To be more specific, FIGS. 16A to 16F show variations of the antenna 2, respectively. FIGS. 16G to 16L show radiation patterns at the XY plane, which are obtained by the variations of the antenna 2.

The variations of the antenna 2 have different dipole lengths Ldp and different loop lengths Llp as shown in FIGS. 16A to 16F. For example, the variation of the antenna 2 shown in FIG. 16 has a dipole length Ldp of 0.72 λ and a loop length Llp of 0.59 λ. It should be noted that the variations of the antenna shown in FIGS. 16A to 16F have different resonance frequencies. That is, the value of "λ" of the variations of the antenna shown in FIGS. 16A to 16F are different from each other.

Figure 17:
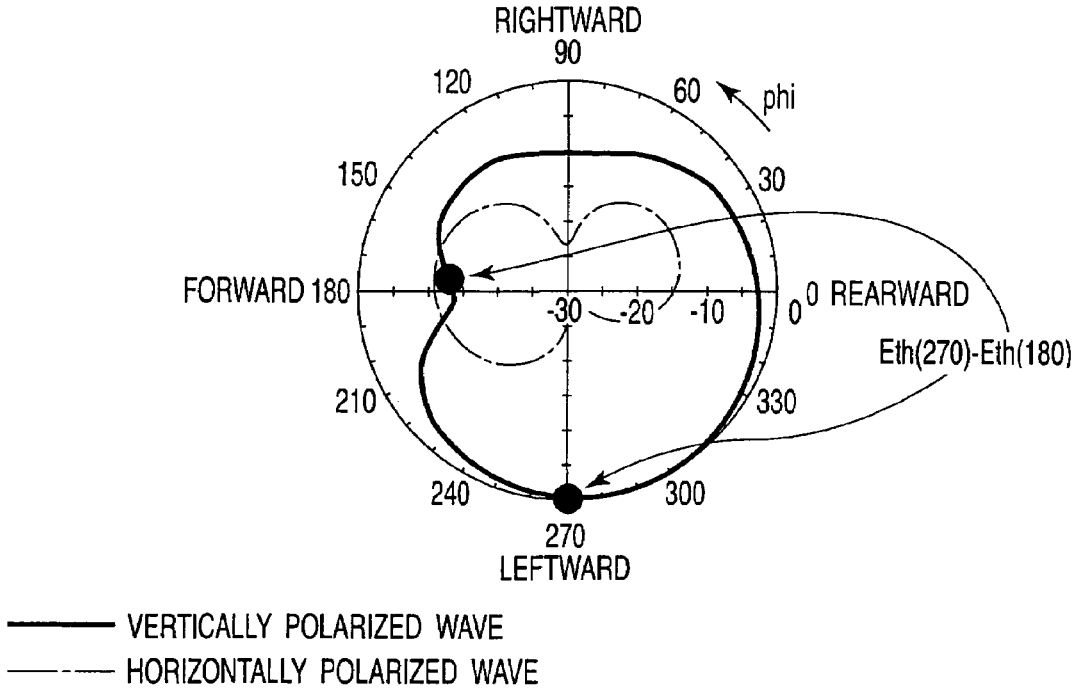
FIG. 17 is a view for use in explaining the relationship between the maximum strength of the vertically polarized wave at the XY plane and the strength of each of the horizontally polarized wave in the forward direction.
Figure 18:
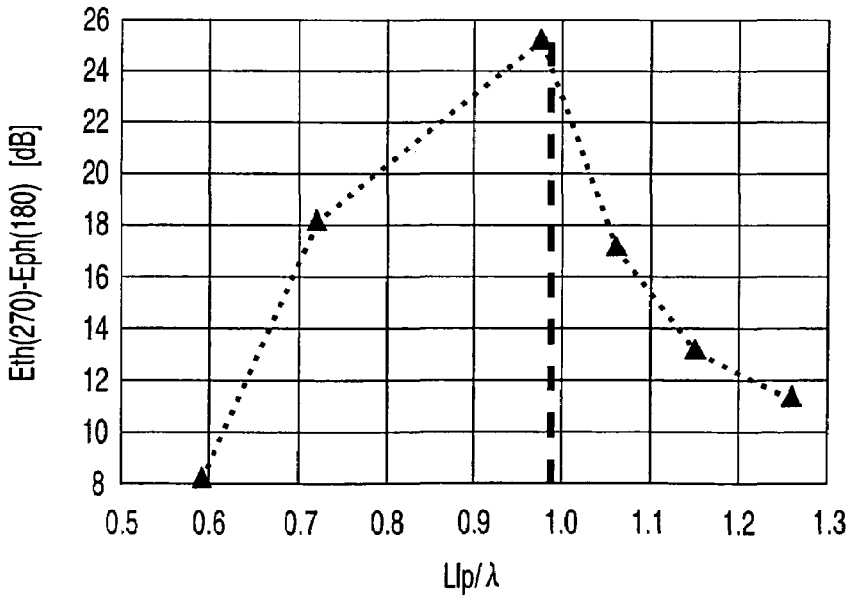
FIG. 18 view graphing the relationship between the loop length Llp and the difference between the forward strength and leftward strength of each of the horizontally polarized waves having radiation patterns at the XY plane, which are shown in FIGS. 16A to 16L.

As shown in FIG. 17, where with respect to the radiation patterns at the XY plane, which are shown in FIGS. 16G to 16L, the maximum strength of each of the vertically polarized waves is Eth(270), and the strength of each of the horizontally polarized waves in the forward direction is Eph(180), as shown in FIGS. 16G to 16L, the relationship between the difference between Eth(270) and Eph(180) and the loop length Llp is graphed as shown in FIG. 18.

The influence of the horizontally polarized wave on radiation of an electromagnetic field in the forward direction decreases as the difference between Eth(270) and Eph(180) increases. It can be said from FIG. 18 that the difference between Eth(270) and Eph(180) is sufficiently great as the loop length Llp is equal to approximately 1 wavelength.

Figure 19:
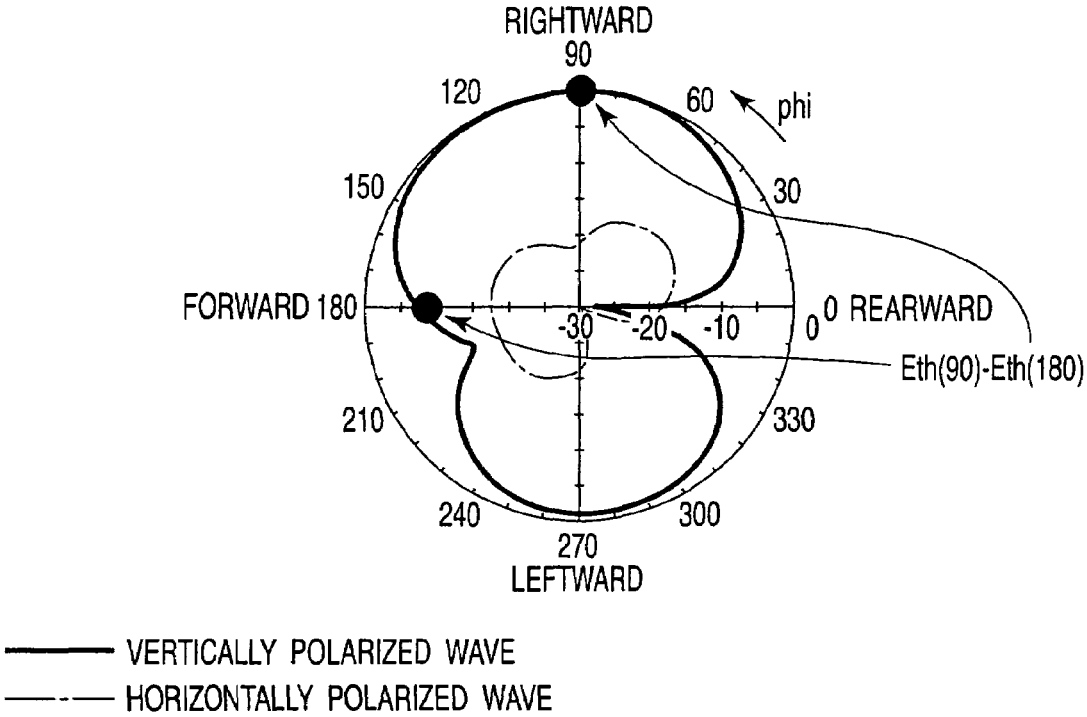
FIG. 19 is a view for use in explaining the difference between the forward strength and rightward strength of the radiation pattern of the vertically polarized wave at the XY plane.

On the other hand, when the balance between the rightward and leftward strengths in the radiation pattern at the XY plane is ideal, the forward strength is the minimum, and the leftward strength is the maximum. Thus, as shown in FIG. 19, where with respect to the radiation patterns of the vertically polarized waves shown in FIGS. 16G to 16L, the forward strength is Eth(180), and the leftward strength is Eth(90), the greater the difference between the leftward and rightward strengths, i.e., "Eth(90)−Eth(180)", the better the balance between the leftward and rightward strengths. The relationship between the above different and the loop length Llp is graphed as shown in FIG. 20.

Figure 20:
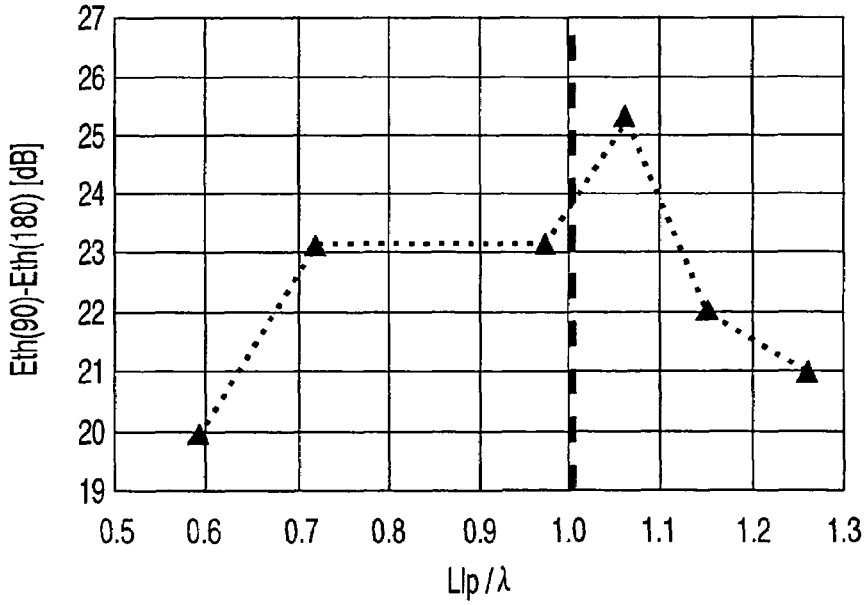
FIG. 20 is a view graphing the relationship between the loop length Llp and the difference between the forward strength and leftward strength of each of the vertically polarized waves having radiation patterns at the XY plane, which are shown in FIGS. 16A to 16L.

As can be seen from FIG. 20, when the loop length Llp is equal to approximately 1 wavelength, the balance between the leftward and rightward strengths is satisfactory.

In such a manner, even when any of the above conditions is applied, when the loop length Llp is equal to approximately 1 wavelength, the balance between the leftward and rightward strengths of the radiation pattern at the XY plane is satisfactory. Therefore, the lengths of the structural elements of the antenna 2 according to the above embodiment are determined such that the loop length Llp is equal to approximately 1 wavelength.

Furthermore, it is preferable that the dipole length Ldp be equal to approximately 0.5 wavelength, since the dipole portion functions as a dipole antenna.

Figure 21:
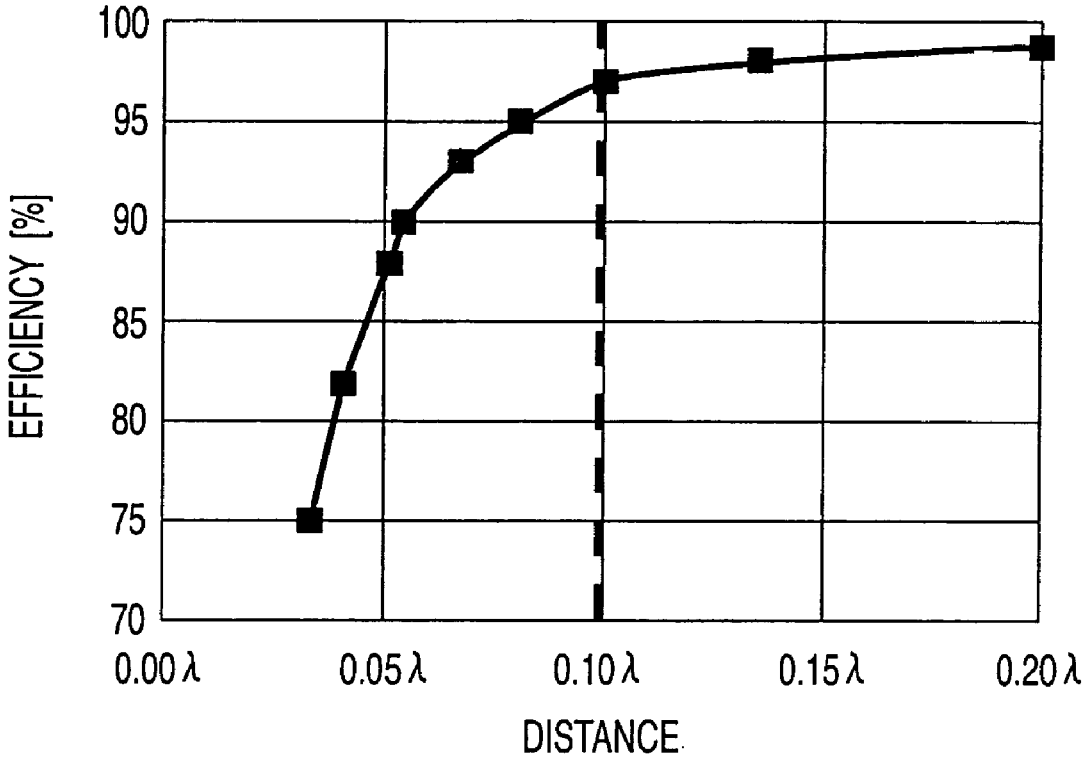
FIG. 21 is a view showing the relationship between the distance between vertical portions 23 and 24 in FIG. 1 and the radiation efficiency.
Figure 22:
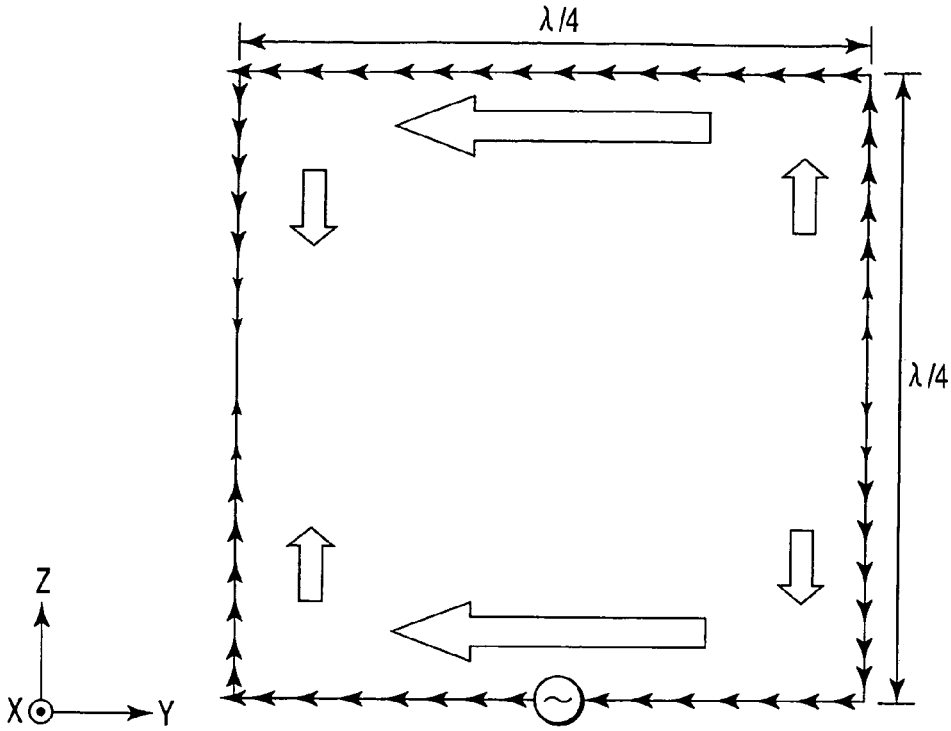
FIG. 22 is a view illustrating the distribution of current at a square 1-wavelength loop antenna.
Figure 23:
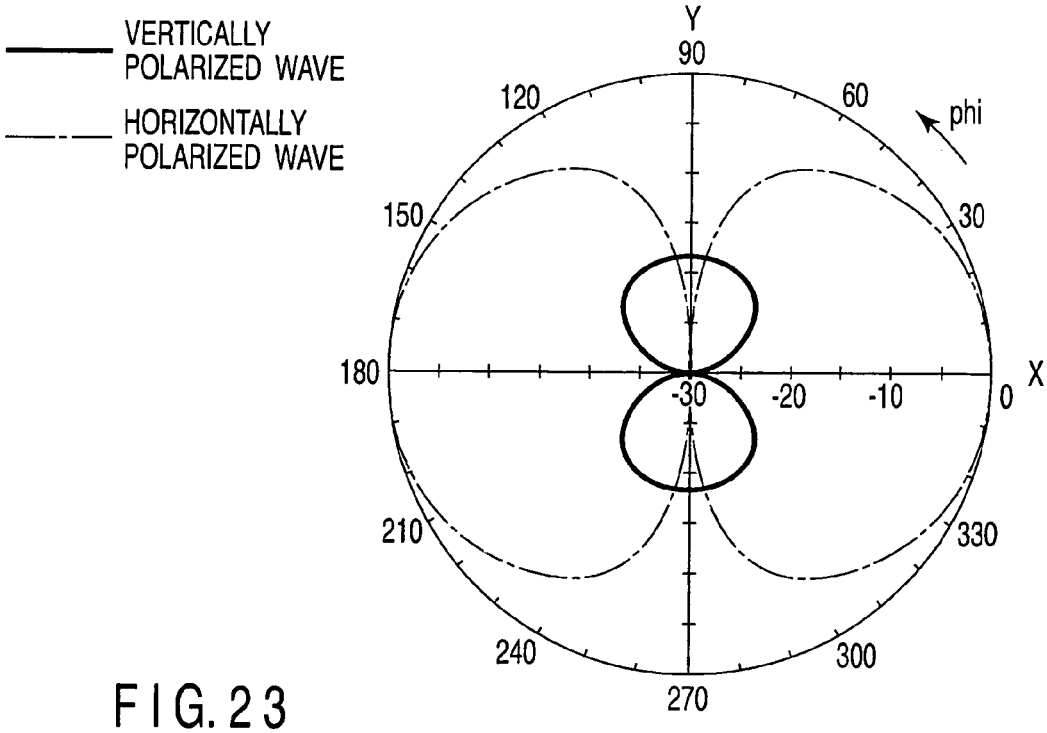
FIG. 23 is a view showing a radiation pattern of a wave at the XY plane, which is radiated from the square 1-wavelength loop antenna shown in FIG. 22.
Figure 24:
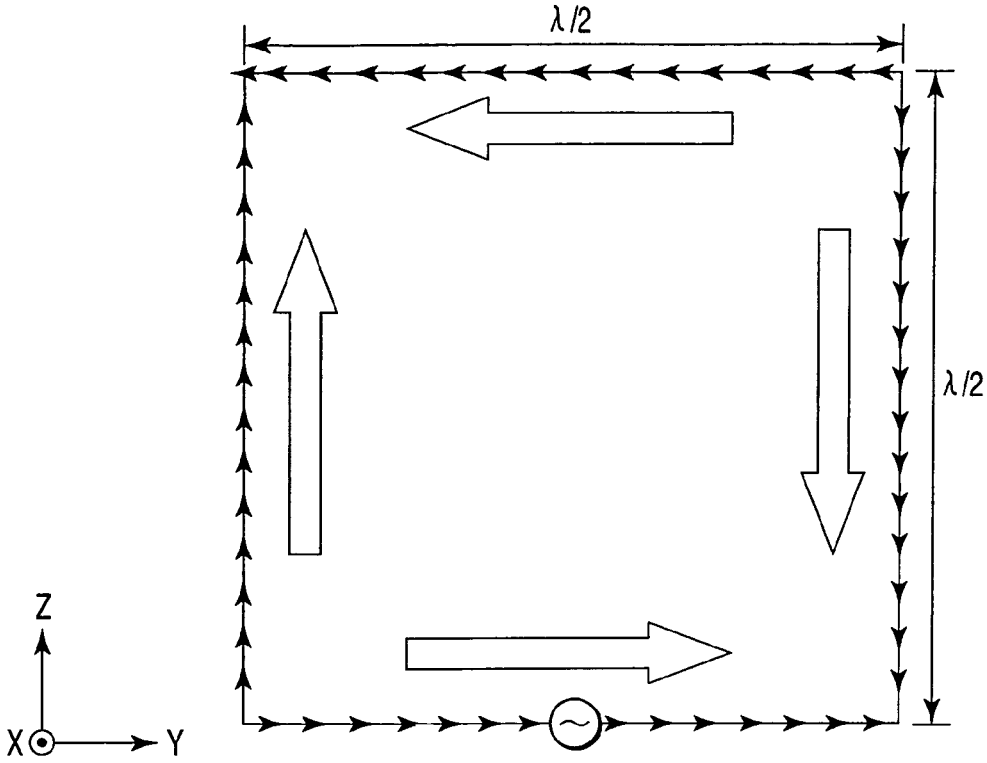
FIG. 24 is a view showing the distribution of current at a square 2-wavelength loop antenna.
Figure 25:
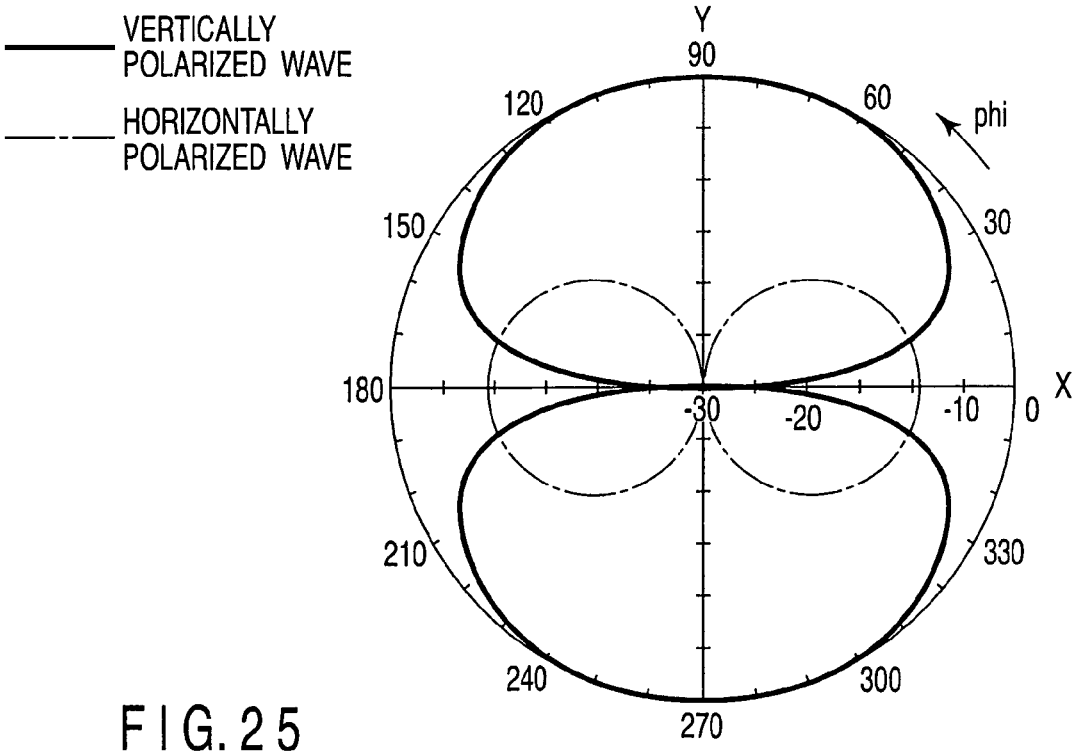
FIG. 25 is a view showing a radiation pattern of a wave at the XY plane, which is radiated from the loop antenna shown in FIG. 24.

FIG. 21 is a view showing the relationship between the radiation efficiency and the distance between the vertical portions 23 and 24. As can be seen from FIG. 21, when the distance between the vertical portions 23 and 24 is equal to or more than 0.1 wavelength, the radiation efficiency is sufficiently great. It is therefore preferable that the distance between the vertical portions 23 and 24 be equal to or more than 0.1 wavelength.

When the above lengths of the structural elements of the antenna 2 are set to satisfy the above condition, it is not necessary for the portable radio communication device according to the embodiment that a balun is provided at the feeding means 4, since the feeding means 4 performs unbalanced feeding. Thus, the portable radio communication device can avoid occurrence of various problems which would arise due to use of a balun. Furthermore, the portable radio communication device according to the embodiment satisfies the following at the same time: unbalanced feeding is performed; and radiation of a wave in the forward direction can be satisfactorily restricted. In addition, in the embodiment, although the antenna 2 has the loop portion, it can be made smaller than a 2-wavelength loop antenna, since its loop length Llp corresponds to 1 wavelength.

The maximum length of the antenna 2 in the forward/rearward direction is sufficiently smaller than the maximum length of the antenna 2 in the upward/downward direction or the rightward/leftward direction. Thus, the antenna 2 can be efficiently provided in the housing 1, which is shaped thin in the forward/rearward direction as shown in FIG. 1. As a result, the resultant portable radio communication device is compact, and in addition can reduce lowering of the communication function which would occur when the living body is located close to the front surface of the housing 1.

When the housing 1 is thin in such a manner, the circuit board 3, etc. are provided in parallel with the antenna 2. In such a case, there is a risk that the radiation of a wave directed toward the circuit board 3, etc. may be attenuated by the circuit board 3, etc., and the loss may be thus great. However, according to the embodiment, the above loss due to the circuit 3, etc. can be restricted, since radiation of an electromagnetic field toward the circuit board 3, etc. is restricted.

The above embodiment can be modified as follows:

The shape of the antenna 2 can be arbitrarily varied. For example, the end portions of the vertical potions 23, 24, 25 and 26 may be bent. The horizontal portions 21 and 22 need not be located parallel to each other. The horizontal portion 21 need not be divided into two parts only with respect to its center. That is, the position at which the horizontal portion 21 is divided is not limited to the center. The vertical portions 23 and 24 need not be located parallel to each other. The vertical portions 25 and 26 need not be located parallel to each other. The vertical portions 24 and 26 need not be oriented to extend along the same axis, i.e., they may be inclined with respect to each other. The shorting portions 27 and 28 may not be located in an imaginary plane perpendicular to the imaginary plane in which the horizontal portions 21 and 22 are located, and may be formed in any shape as long as they are connected to the ends of the horizontal portions 21 and 22 on their sides. The shorting portions 27 and 28 need not be located parallel to each other. However, the balance of the radiation pattern in the vertical direction lowers as the symmetry between the upper half and the lower half of the antenna 2 lowers. Also, the balance of the radiation pattern in the horizontal direction lowers as the symmetry between the left half and the right half of the antenna 2 lowers. It is therefore preferable that the antenna 2 is shaped such that the symmetry between the upper and the lower halves of the antenna 2 and that between the left and right halves of the antenna 2 be set as higher as possible.

The present invention is not limited to a portable radio communication device. That is, the invention can be applied to another kind of radio communication device.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. An antenna which at least one of transmits and receives a radio wave of a predetermined frequency, comprising:

a first portion and a second portion, which are located opposite to each other in a first direction; and a pair of dipole portions that are open at both ends;

wherein the dipole portions are located opposite to each other in a second direction that is substantially perpendicular to the first direction, a part of a first one of the dipole portions is connected to a first end of the first portion and a first end of the second portion, and a part of a second one of the dipole portions is connected to a second end of the first portion and a second end of the second portion; and wherein the first portion, the second portion, and the parts of the dipole portions define a shape of a portion having a length corresponding to substantially one wavelength of the radio wave.

2. The antenna according to claim 1, wherein the portion shaped by the first portion, the second portion, and the parts of the dipole portions is symmetrical with respect to an imaginary plane located at a midpoint between the first portion and the second portion and perpendicular to the first direction.

3. The antenna according to claim 1, wherein the pair of dipole portions are symmetrical with respect to each other with respect to an imaginary plane perpendicular to the second direction.

4. The antenna according to claim 1, wherein each of the pair of dipole portions has a length corresponding to 0.5 wavelength of the radio wave.

5. The antenna according to claim 1, wherein the pair of dipole portions are spaced apart from each other by a distance corresponding to at least 0.1 wavelength of the radio wave.

6. A radio communication device comprising:

an antenna which at least one of transmits and receives a radio wave of a predetermined frequency, comprising (i) a first portion and a second portion, which are located opposite to each other in a first direction, and (ii) a pair of dipole portions that are open at both ends; and feeding means for performing unbalanced feeding on the first portion;

wherein the dipole portions are located opposite to each other in a second direction that is substantially perpendicular to the first direction, a part of a first one of the dipole portions is connected to a first end of the first portion and a first end of the second portion, and a part of a second one of the dipole portions is connected to a second end of the first portion and a second end of the second portion; and wherein the first portion, the second portion, and the parts of the dipole portions define a shape of a portion having a length corresponding to substantially one wavelength of the radio wave.

* * * * *